US007220375B2

(12) United States Patent
Haas et al.

(10) Patent No.: US 7,220,375 B2
(45) Date of Patent: May 22, 2007

(54) METHOD AND SINGLE OR MULTIPLE PLATEN PRESS FOR THE MANUFACTURE OF WOOD MATERIAL BOARDS

(75) Inventors: Gernot von Haas, Leimen (DE); Gerhard Melzer, Lautertal (DE)

(73) Assignee: Dieffenbacher GmbH + Co. KG, Eppingen (DE)

( * ) Notice: Subject to any disclaimer, the term of this patent is extended or adjusted under 35 U.S.C. 154(b) by 458 days.

(21) Appl. No.: 10/915,710

(22) Filed: Aug. 11, 2004

(65) Prior Publication Data

US 2005/0082709 A1 Apr. 21, 2005

(30) Foreign Application Priority Data

Aug. 11, 2003 (DE) ..... 103 37 117

(51) Int. Cl.
*B27N 3/20* (2006.01)

(52) U.S. Cl. ..... 264/109; 264/83; 264/102; 425/406

(58) Field of Classification Search ..... None
See application file for complete search history.

(56) References Cited

U.S. PATENT DOCUMENTS 4,357,194 A * 11/1982 Stofko ..... 156/308.6
4,393,019 A * 7/1983 Geimer ..... 264/83
4,517,147 A 5/1985 Taylor et al.
4,850,849 A * 7/1989 Hsu ..... 425/407
4,937,024 A * 6/1990 Hickson ..... 264/83
6,054,081 A * 4/2000 Bielfeldt ..... 264/83
2002/0140121 A1* 10/2002 von Haas ..... 264/40.1
2006/0024400 A1* 2/2006 Crooks ..... 425/346

FOREIGN PATENT DOCUMENTS

CH 463 774 10/1968
DE 1 276 912 9/1968
EP 0 172 930 3/1986

* cited by examiner

*Primary Examiner*—Mary Lynn Theisen
(74) *Attorney, Agent, or Firm*—Foley & Lardner LLP

(57) ABSTRACT

A method and a multi-platen press for the practice of the process for the manufacture of wood material boards, especially OSB boards, in which an endless mat is formed from a wood chip and binding agent mixture. The mat is introduced between the heated press platens of a multi-platen press, the press platens have steam openings directed at the mat and by steam and contact heat from press platens they are heated, pressed and cured into wood material boards. The mat, formed from a wood chip and phenolic resin mixture, is introduced into the level(s) of a single-stage or multi-stage press and deposited therein. After a light pre-compression, the introduction of a small amount of steam with a low steam temperature takes place through the press platens only in the cover layers of the mat. The mat is quickly compressed and cured to the end thickness of the board.

31 Claims, 3 Drawing Sheets

METHOD AND SINGLE OR MULTIPLE PLATEN PRESS FOR THE MANUFACTURE OF WOOD MATERIAL BOARDS

The invention relates to a method for the manufacture of wood material boards, especially OSB boards. This patent also relates to a multiple platen press for the practice of the method for the manufacture of wood material boards.

BACKGROUND

It is known, from DE 12 76 912 C2 and CH 46 37 74 C1, that in steam pressing the mat is first compressed, then steam is introduced, and then it is further compressed. Thus, in EP 0 172 930 A1 a process for steam pressing has become known wherein the mat is first compressed without steam to 50% of the final thickness and then further steamed in various flushing steps. It is common to this patent family that the mat is first slightly compressed and then the entire cross section of the mat is heated by the introduction of steam to the steam temperature.

The boards made according to CH 46 37 74 C1 and the other older patents often had blow-outs, and dark spots were to be seen on the board surface. The board strength, especially the cross-tensional strength in the areas of the dark spots is considerably lower than in the rest of the board area. The dark spots are situated opposite holes out of which the steam flows. The fiber-to-glue structure is destroyed also by the high velocity of flow of the steam and the large amount of steam that flows through this area. A study has shown that the strength of the board is reduced particularly in the outer areas, since in this area the phenolic resin becomes washed out.

In U.S. Pat. No. 4,517,147 it is described how boards can be manufactured by steam pressing without blow-outs and traces of the steam holes in the board surface. U.S. Pat. No. 4,517,147 proposes a reduction of the steam velocity under the holes. This is to be achieved by the use of a special screen between the mat and the heating plate. Also, the mat density and the steam pressure are to be set low. In spite of the many proposals for a solution it has been impossible to date to press phenolic resin-treated wood chips to form OSB boards, because in OSB manufacture in multi-stage presses the pressing time is relatively long in comparison to other wood materials. Thus, the press factor for an OSB board 11 mm thick is 12 s/mm, while the press factor for a chip board amounts, for example, to only 6 s/mm.

SUMMARY

The invention is addressed to the problem of giving a method whereby wood materials, especially wood strands glued with phenolic resin, are pressed with considerably reduced pressing time in cyclic presses, single-stage presses or multi-stage presses and of creating a multi-stage press for the practice of the method.

This problem is solved by the following process steps: first, the mat of raw material made of a mixture of wood chips and phenolic resin is shaped and introduced into the levels of a single or multi-level press and deposited therein; after a slight preliminary compression, a small amount of steam at a low temperature is introduced through the press plates only into the cover layers of the mat; and then the mat is rapidly compressed to the final thickness of the board and cured.

According to an embodiment of the invention, a method of manufacturing wood material boards, especially OSB boards, is provided, wherein an endless mat of the material to be pressed is formed from a mixture of wood chips and binding agent, and is introduced between the heated press platens of a multi-platen press, the press platens having, in a second plane, steam directing channels fed at the margin from steam distributing channels having steam openings directed toward the mat, and therein, by means of steam and press platen contact heat, the mat is heated, pressed and cured into wood material boards. The method comprises the following steps: the mat is formed from a wood chip and phenolic resin mixture and introduced into the platen(s) of a single or multi-platen press and deposited therein; after a light precompression a small amount of steam is introduced with a low steam temperature taking place through the press platens only into the cover layers of the mat; and then the mat is rapidly compressed to the final thickness of the board and cured.

According to another embodiment of the present invention, a multi-platen press for practice of the method is provided. The multi-platen press comprises one or more levels of press platens, and a heating system with heat ducts and with at least one steaming system with steam distribution ducts and steam directing ducts for the press platens. The steam directing ducts being equipped with steam orifices at the press surface and a vacuum system and, with the exception of the brief steaming period, an air aspiration system can be connected to the steaming system. The steam orifices are made with a reduction of the bore diameter from 6 mm to 3 mm toward the mat as a self-cleaning configuration.

It is to be understood that both the foregoing general description and the following detailed description are exemplary and explanatory only, and are not restrictive of the invention as claimed. Additional advantageous measures and configurations of the subject matter of the invention will be found in the sub-claims and the following description with drawing.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Hereinafter, embodiments of the present invention will be described with reference to the attached drawings. An effort has been made to use the same reference numbers throughout the drawings to refer to the same or like parts.

Figure 1:
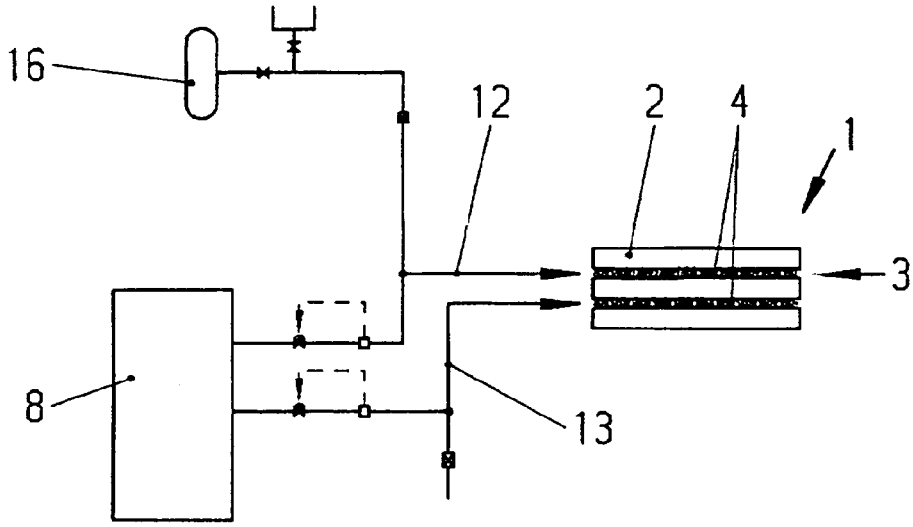
FIG. 1 is a diagrammatic sectional view of two levels of a multi-platen press for the practice of the method with the steaming system.

The sectional view represented in FIG. 1 shows a section of a multi-platen press 1 with three press platens 2, two levels (stages) 3, the steam system with steam accumulator (storage) 8, the steam lines 12 issuing therefrom through two shut-off valves, a steam exhause (outlet) 13 and a vacuum system 16. Two mats 4 of material for pressing are deposited in the two levels 3.

Figure 2:
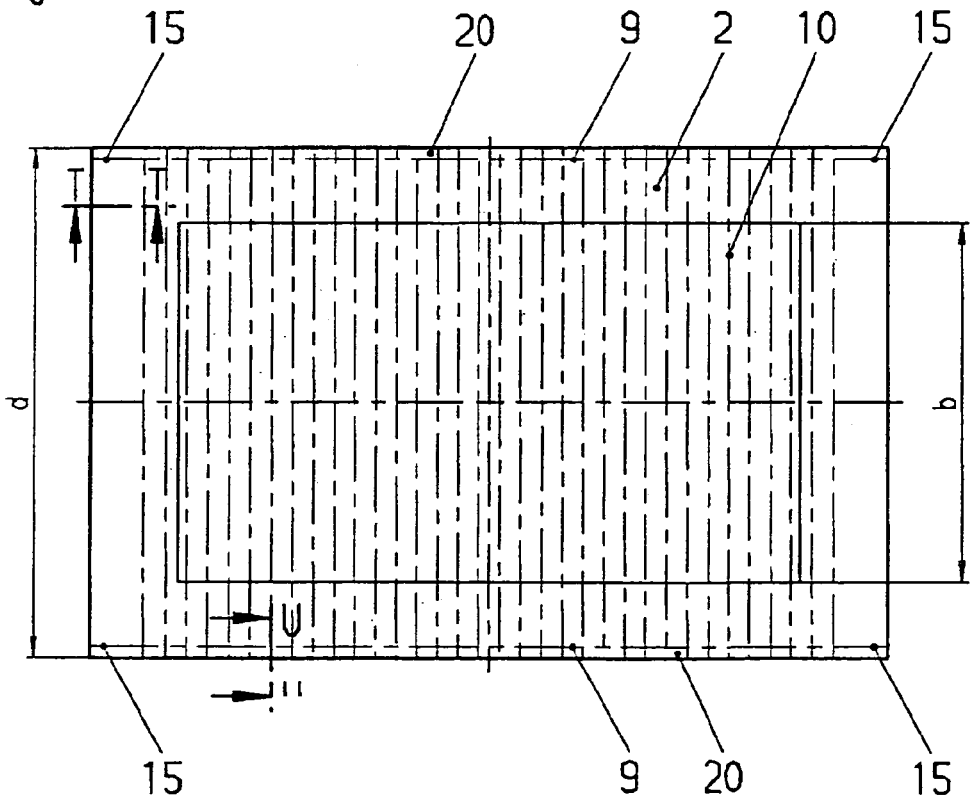
FIG. 2 is a top view of a press platen with steam distribution ducts and the steam directing ducts.
Figure 3:
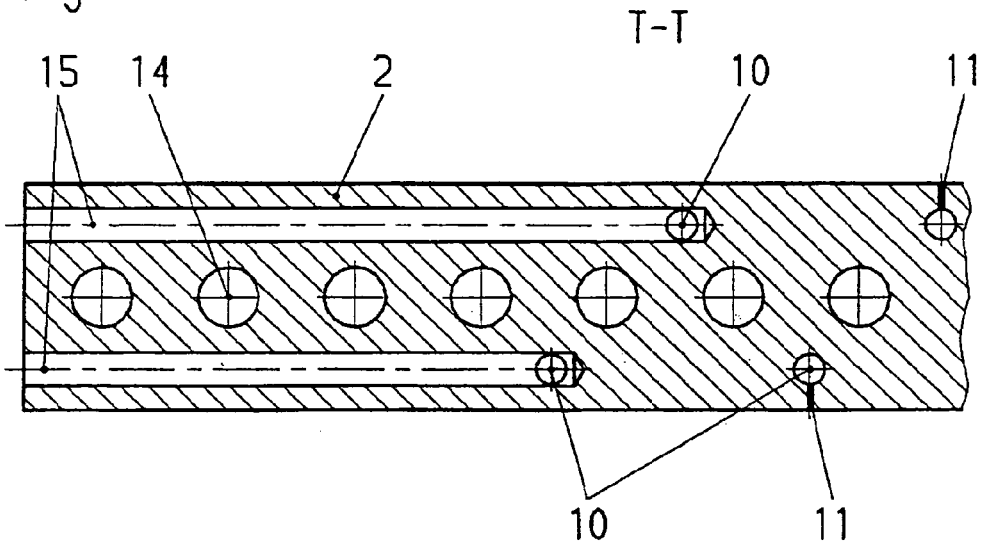
FIG. 3 is a section T—T from FIG. 2, the bores of the steam input, steam directing ducts and the steam orifices with the heating channels.
Figure 4:
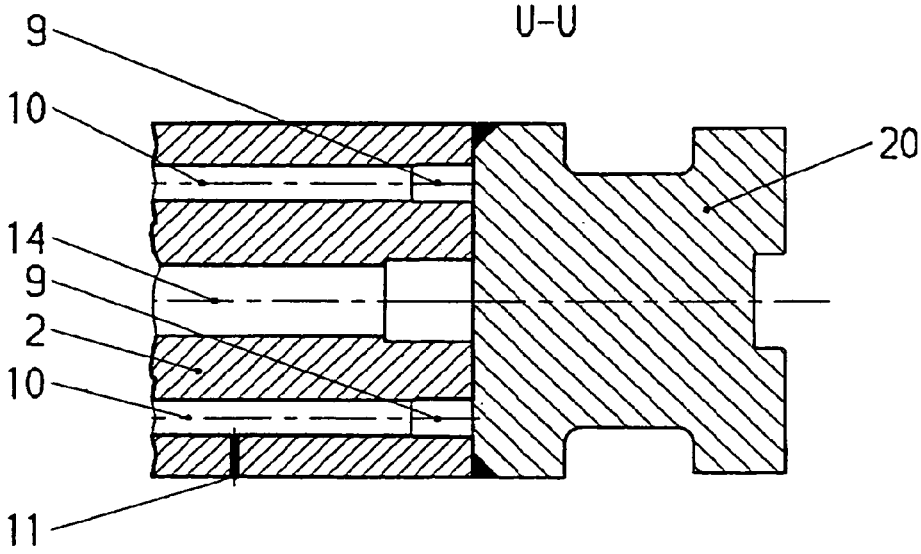
FIG. 4 is a section U—U from FIG. 2, the construction of a press platen with edging.

FIGS. 2, 3 and 4 show the configuration of a press platen 2 with three levels of bores for arrangement between at least one upper and one lower press platen 2. Such a press platen 2 serving as an intermediate platen is made with heat ducts 14 in the center and a first upper bore level with steam directing ducts 10 (passage or channel) and a second lower bore level with steam directing ducts 10. Steam is fed into the steam distribution ducts 9 (passage or channel) from a left and from a right steam distribution duct 9. The two steam distribution ducts 9 are supplied with steam from four steam inlets 15 and are closed off by marginal strips 20 from the outside air. Many steam orifices (ports) 11 distributed over the plane of the press are bored for introducing steam into the mats 4. Through separate passages (not shown) to the steam system, a vacuum system 16 and an air exhausting system are provided with lines 12 to the steam exhaust 13.

Figure 5:
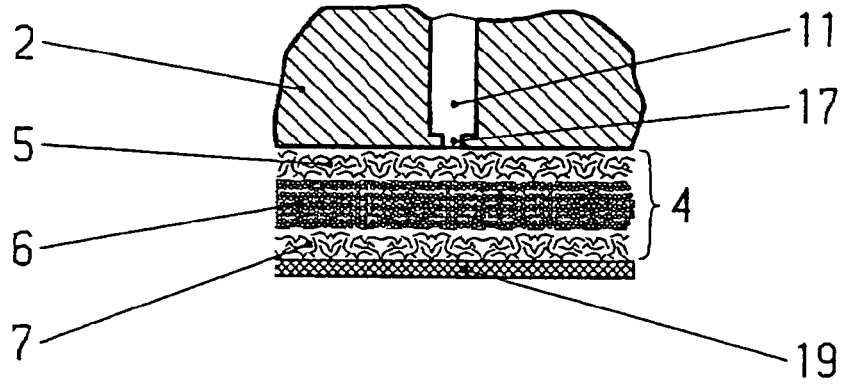
FIG. 5 is a section of the press platen with a steam opening aimed at the mat.
Figure 6:
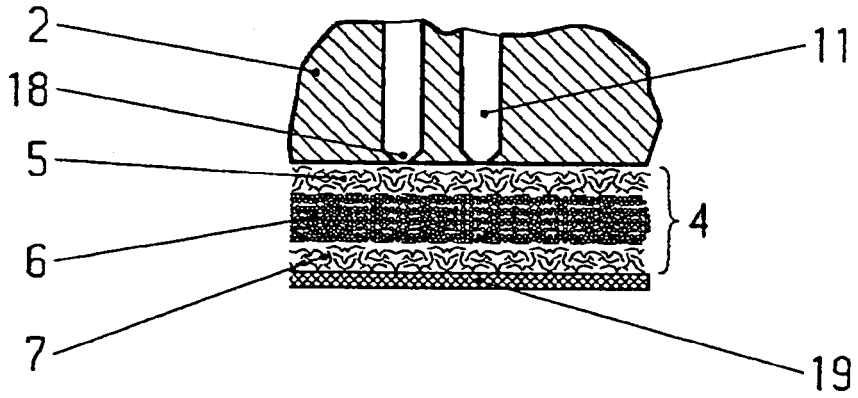
FIG. 6 is a section with the configuration of the steam orifice in the form of a slot.

For the self-cleaning of the steam orifices 11, the latter are made, according to FIGS. 5 and 6, like steam opening bore (orifice) 17 or like slot (slit) 18, so that, for example, the bore diameter tapers from 6 mm to 3 mm. For the air exhaust system it is advantageous that two loading screens or stationary screens 19 are arranged at least on the top side of the press platens 2. The pressing plane can advantageously be matched to the size of the mat 4 by making the width d of the press platen 2 not more than about 200 mm larger than the average mat width b. This can be brought about by stopping the steam orifices 11 with plugs so that, for example, the steaming area less the two marginal strips 20 can be adjusted from 200 mm to 700 mm.

Figure 7:
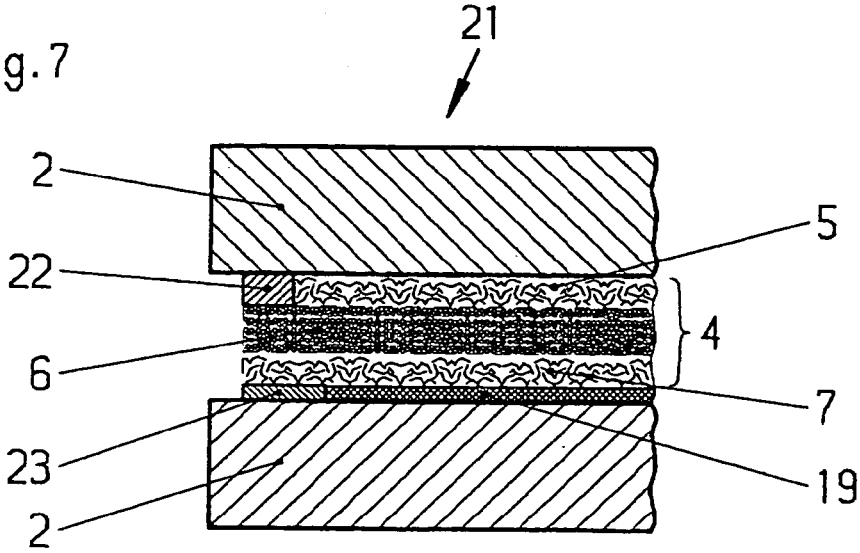
FIG. 7 is the configuration of the marginal portion of a single platen press during the pressing operation.

As shown in FIGS. 5 to 7, the mat 4 consists of the cover layers 5 and 7 and the middle layer 6. The steaming is applied only to the surface or cover layers 5 and 7. In FIG. 7, the sealing off of the mat 4 is performed, for example, in a single platen press 21 within the pressing plane through a marginal seal 23 of the screen 19 and/or by a sealing bar 22 reducing the press gap.

Surprisingly it was found that, through the controlled introduction of a small amount of steam in a brief period of time at a low steam temperature into a lightly compressed mat 4, the phenolic adhesive is not washed out by the method of the invention. There are several reasons for this. In the process of washing out the phenolic adhesive the latter is first dissolved in the steam condensed in the strand and then transported with the steam flow into the interior of the mat 4. In the mat 4 interior the adhesive precipitates with the water and is partially absorbed by the wood.

Since the dissolving of the phenolic adhesive is a process which depends primarily on the amount of steam flowing between the strands, only a little adhesive dissolves with a small amount of steam during the steaming, combined with subsequent compression, before curing. That is, the less steam that flows around the phenolic adhesive the less is the probability that adhesive will be washed out.

Furthermore the washing out is a time-dependent process. The longer the flow of steam continues the less viscous the adhesive becomes and the sooner the adhesive dissolves in the steam.

It has proven especially advantageous to operate with the following parameters:

- The preliminary compression of the mat 4 is performed until a mat density of 100 to 500 kg/m2 is achieved, according to the mat thickness.
- The steaming of the mat 4 is performed for a period of 2 to 15 seconds.
- The steam is adjusted to as low a temperature as possible and is introduced into the cover layers 5 and 7 of the mat 4 with a temperature of 110° C., and
- The steam, as saturated as possible and only slightly superheated, is used, or steam no more than 20° C. superheated is used.

Accordingly, what is important to prevent wash-out of the phenolic resin adhesive from the mat 4 is the steam temperature that results from the degree of saturation of the steam and the chosen steam pressure, since with increasing steam temperature the adhesive becomes more fluid, and the solubility of the adhesive increases with the heat. The process must be conducted so that the steam temperature is set as low as possible by setting the steam pressure as low as possible, and steam as saturated as possible but only slightly superheated (maximum 20° C.) is used.

Likewise, the velocity of flow of the steam is important as regards washout. Washout occurs at reduced velocity of flow to a far lesser degree, and that velocity is greatly reduced by the only slightly compressed mat 4. The velocity of flow is furthermore reduced at the same depth of penetration and steaming time if the width of the strand and strand length are not too great. Since the steam can not flow through the strands it has to flow around the strands. That is to say that, in the case of very wide strands, a greater distance has to be covered in the same amount of time for the same depth of penetration, and thus the velocity of flow increases. It is therefore desirable if in the chip and binder mixture the average chip lengths are no greater than 150 mm and the average chip width is no greater than 25 mm, and for the production of especially smooth surfaces on the boards, chips only 0.5 mm thick are used.

Steaming is therefore so conducted that, after a slight preliminary compression, only the surface layers or only one of the surface layers is steamed briefly, so that any washout of the adhesive by any great amount of steam flowing over the strands does not occur, and then compression is performed quickly to the final thickness.

Steaming the mat 4 with the amount of heat necessary to heat it from 30° C. to 100° C. can be considered complete with respect to the condensation heat released by the steam at a moisture of 5 to 6% per square meter. To heat the surface layers, an amount of steam of 60 to 185 g/m2 is put in such that then the defined amount of steam penetrates into about 30% of the mat 4 or the amount of steam in each surface penetrates to 15% of the depth of the mat 4.

The amount of steam introduced per side and the steaming time is the control variable of the process. The flow-through rate (amount of steam per unit time [kg/h]) is reckoned from the amount of steam to be introduced per m2 of mat 4 area and the prescribed steaming time, and entered into a flow controller. The steam velocity is the velocity of the steam front (condensation front) which penetrates from the surface toward the core of the mat 4. It is calculated from the time it takes for heating the particular depth in the mat 4 being heated. The mat 4 depth to be heated is calculated from the amount of steam that is to be put into the mat 4.

The steam pressure needed for a surface layer steaming thus results from the steaming time, the amount of steam and the mat density. With these process parameters the amount of dissolution of the phenolic resin adhesive can be controlled during the steaming operation.

An advantage is the separate introduction of the amount of steam into the top surface and bottom surface of the mat 4, and if necessary under different control. The steam amount and mat density process parameters can also be varied if the adhesive treatment of the material with phenolic resin is performed with a mixture of powder and liquid adhesive.

The specific pressure which is established in the case of various OSB mat 4 densities is very low for mat 4 densities between 100 and 500 kg/m3.

In the case of cyclic pressing it has been found good to perform the steaming by controlling the stroke of the press in order to be able to arrive securely at a targeted mat density during the steaming operation.

If a multistage press with rotating screens 19 made of metal fabric is used, a brief (about 0.5–2 seconds) screen expansion phase must be established in the pressing schedule after the screen 19 is heated at around 100° C. at low specific pressure. The length of time for the closing of a conventional multistage press must be about 13 seconds from the time when the screen 19 makes contact with the hot press platen 2 until a clearance of 40 mm is reached (in the case of an opening width of 305 mm) In this period of time the screen 19 can be heated to a temperature of over 100° C.

In the case of preliminary steaming, the so-called screen 19 expansion phase can be used for a preliminary steaming of the surface layers.

The shortening of the pressing factor is based on a faster heating of the mat's 4 core to 100° C., and two causes can be given for the quicker heating. First, the moisture in the outer layers of the mat 4 is increased, which contributes to the faster warming as in the case of the spraying of the mat 4. Secondly, the outer portion of the mat 4 is already heated to over 100° C., so that less energy has to be delivered by conduction to the mat 4 through the press platens 2. Uniform penetration of the steam front over the entire platen width is promoted by the high resistance to flow of OSB perpendicular to the mat 4 surface and the low resistance to flow parallel to the mat 4 surface.

The use of a mixture of liquid phenolic adhesive and powdered phenolic adhesive in the OSB surface layer can be considered advantageous, because the mixture of liquid and powdered phenolic adhesive is as a rule less quickly washed out than plain liquid phenolic adhesive. A plain steaming of the surface layer has very little influence on the curing of the adhesive in the core layer, so that the choice of the adhesive in the core layer is independent of the steaming requirements. Thus, for example, an MDI adhesive or a combination of MDI with phenolic adhesive can be used in the core layer.

Gaseous reaction accelerators or other substances such as fire retardants, insecticides or fungicides can be put into the mat 4 with the steam.

It has furthermore been found a special advantage that the steaming of the surface layers permits pressing to precise thickness even in the multistage press, since the mat's 4 core has not yet softened at the moment the press is closed. The conventional steam pressing methods both of chip mats, fiber mats and OSB mats 4 have heretofore been performed only on single-stage cyclic presses, since complete steaming of the mat 4 causes the specific press pressure to be greatly reduced. Due to the low counter pressure the closing of the press requires a very precise control of the press, especially in regard to any tilting of the press table. Furthermore, the thickness tolerances of the boards are harder to maintain in the individual stages if the mat 4 has a very low press counter pressure. The surface layer steaming according to the invention only slightly (about 10–20%) reduces the maximum specific press pressure, so that problems do not occur in connection with the position control of the press and the board thickness tolerances in the individual stages.

Boards from multi-stage presses are distinguished from boards from continuous presses by a thicker press skin and a very low density in the outer mat 4 layers. The surface layer steaming according to the invention can also be used preferentially for surface plastification. With surface plastification combined with an appropriate press pressure a tighter and smoother surface can be obtained by heating and wetting the chips and strands and rapidly closing the press. It is important that at the moment of the high specific pressure the chips and strands on the mat 4 surface are not fully dried. Particularly smooth surfaces on OSB boards can be produced with thin strands of uniform thickness (thickness less than 0.5 mm). The OSB boards thus produced can be covered with films or resined papers without any further treatment and can be used in places formerly reserved for plywood.

The flexural strength and flexural modulus of elasticity are also improved by surface layer steaming since the surface layers—as described above—have slightly more compression, so that for the same average density a greater density is present in the outer side of the board in flexure.

In the press platens 2 of a multi-stage press, steam vent holes facing the mat 4 are provided. It has been found that the steam vent holes which come in direct contact with the mat 4 on its face side become clogged after some time by wood components, adhesives and additives. Since according to embodiments of this invention, when the pressing begins the steam is carried into the mat 4 with only a slight steam pressure, there is also the danger of clogging the holes. By a higher-pressure pulse of steam or a pulse of compressed air the bores, however, can be blown clear. This steam pulse or compressed-air pulse should preferably be performed while the press is open, if possible before the press is loaded with the new mat 4. To apply a good high pressure it is desirable to apply the steam pulse only to the bottom of the hot plate (upper side of the mat 4).

By keeping the steam vents free against a vacuum 16 of an order of magnitude of 0.2 to 0.9 bar (absolute) at the end of the hot pressing, the steam pressure in the platen can be reduced so that the steam exhaust pressure (and hence the pressing time) can be shortened and the danger of blow-outs is reduced.

Recently the air purity requirements have become ever more stringent. In the meantime the press exhaust (press waste gases) must also satisfy certain VOC (volatile organic components) and dust requirements. Conventionally, the press is provided with a large exhaust hood and is cleared by a high powered blower. The costs of cleaning the large amount of exhaust air are greater than the cleaning of a small exhaust output containing a greater concentration of substances. This is especially true when the exhaust is cleaned through an RTO—i.e., an afterburner. The greater part of the press exhaust gases from a conventional pressing with a screen 19 underneath passes during the hot pressing operation by transport through the screen 19 from the platen interior at the narrow surfaces of the screen 19 or the end surfaces of the press. Only a small amount of exhaust gases enter the press chamber through the narrow surfaces of the platen during the pressing and through the platen surface after the press is opened.

The multi-platen press 1 according to an embodiment of the invention can, as a special advantage, be made without a comprehensive exhaust system if during the entire pressing, with the exception of a short steaming period, at least one side of the mat 4, preferably the screen 19 side, is exhausted at 0.02 bar through the steam holes. When the steaming is done on one side, only from above, the exhaust system can be turned on at the bottom of the mat 4 (screen 19 side) while the screen 19 is entering the press. Due to the fact that the exhausting is performed through the steam holes in the screen 19 side and due to the possible combination of the measure of edge sealing described above with the application of a vacuum 16 toward the end of the pressing operation, virtually no press exhaust gets into the shed. The board is purged, so to speak, during the hot pressing operation while still in the press, so that the board emits but very little exhaust gases during the opening of the press and thereafter.

The amounts that are exhausted through the holes are substantially smaller than those exhausted from the entire press. The substances removed consist nearly exclusively of water vapor and the substances given off by the wood, adhesive and other additives such as wax, so that the air can be scrubbed primarily by condensing the water vapor.

When the surface layers of the mat 4 are steamed on one side it is desirable to steam the bottom surface layer and, before putting the mat 4 into the press, to wet the top side with water.

According to a first embodiment of the invention, a method for the manufacture of wood material boards, especially OSB boards, is provided wherein an endless mat 4 of the material to be pressed is formed from a mixture of wood chips and binding agent, and is introduced between the heated press platens 2 of a multi-platen press 1, the press platens 2 having, in a second plane, steam directing channels 10 fed at the margin from steam distributing channels 9 having steam openings 11 directed toward the mat 4, and therein, by means of steam and press platen 2 contact heat, the mat 4 is heated, pressed and cured into wood material boards. The method comprises the following process steps: the mat 4 is formed from a wood chip and phenolic resin mixture and introduced into the platen(s) of a single 21 or multi-platen press 1 and deposited therein; after a light precompression the introduction of a small amount of steam with a low steam temperature takes place through the press platens 2 only into the cover layers 5 and 7 of the mat 4; and then the mat 4 is rapidly compressed to the final thickness of the board and cured.

A second embodiment, according to the first embodiment, provides a method wherein the precompression of the mat 4 is performed to a mat density of 100 to 500 kg/m$^3$ depending on the mat thickness.

A third embodiment, according to embodiments 1 and 2, is provided wherein the steaming of the mat 4 takes place during a time period of 2 to 15 seconds.

A fourth embodiment, according to embodiments 1 to 3, is provided wherein the injection of the steam into the cover layers 5 and 7 of the mat 4 takes place with an amount of 60 to 185 g/m$^2$ according to the mat thickness.

A fifth embodiment, according to embodiments 1 to 4, is provided wherein the defined amount of steam is put into about 30% of the mass of the mat 4 or the amount of steam per surface penetrates into 15% of the depth of the mat 4.

A sixth embodiment, according to embodiments 1 to 5, is provided wherein the steam is introduced with a temperature of 110° C. into the cover layers 5 and 7 of the mat 4.

A seventh embodiment, according to embodiments 1 to 6, is provided wherein highly saturated steam and only slightly superheated steam is used, or steam superheated by only 20° C. is used.

An eighth embodiment, according to embodiments 1 to 7, is provided wherein only the cover layers 5 and 7 are formed from a wood chip/phenolic resin mixture, while the wood chips of the middle layer 6 of the mat 4 are mixed with an MDI adhesive or other appropriate binding agent.

A ninth embodiment, according to embodiments 1 to 8, is provided wherein the steam temperature is set as low as possible.

A tenth embodiment, according to embodiments 1 to 9, is provided wherein the introduction of the quantity of steam is regulated separately on the top surface and bottom surface of the mat 4.

An eleventh embodiment, according to embodiments 1 to 10, is provided wherein after the light precompression a defined amount of steam is introduced only into one of the surface layers 5 or 7 of the mat 4 through the press platens 2 and then the mat 4 is compressed to the finished dimension of the board.

A twelfth embodiment, according to embodiments 1 to 11, is provided wherein the treatment of the material with phenolic resin is performed with a mixture of adhesive powder and liquid glue.

A thirteenth embodiment, according to embodiments 1 to 12, is provided wherein in the wood chip and binding agent mixture the average chip lengths are not greater than 150 mm and the average chip widths are not greater than 25 mm.

A fourteenth embodiment, according to embodiments 1 to 13, is provided wherein, for the production of especially smooth surfaces on the boards, thin chips with a slight thickness of 0.5 mm are used.

A fifteenth embodiment, according to one or more of embodiments 1 to 14, is provided wherein in the case of multi-stage presses a screen 19 rotation is provided, wherein the heating of the screen 19 to about 100° C. is established in the press program at low specific pressure.

A sixteenth embodiment, according to one or more of embodiments 1 to 15, is provided wherein the preheating of the screen 19 at 100° C. is performed during the closing procedure of the platens 3.

A seventeeth embodiment, according to one or more of embodiments 1 to 16, is provided wherein a vacuuming of the mat 4 and of the finished board is performed during the overall pressing process.

An eighteenth embodiment, according to one or more of embodiments 1 to 16, is provided wherein, at the end of the pressing process a vacuum 16 of 0.2 to 0.9 bar is applied to the steam directing ducts 10 of the press platens 2.

A nineteenth embodiment, according to one or more of embodiments 1 to 18, is provided wherein separate ducts to the upper and lower steam directing ducts 10 are provided in a press platen 2 and a high-pressure pulse of high pressure steam is performed through these ducts at the end of the pressing.

A twentieth embodiment, according to one or more of embodiments 1 to 19, is provided wherein in the case of unilateral steaming of the mat 4 from underneath, its upper side is sprayed with water before entry into the press.

A twenty-first embodiment, according to one or more of embodiments 1 to 20, is provided wherein the aspiration from the mat 4 is performed at about 0.02 bar during the pressing procedure.

The multi-platen press 1 for the practice of the method consists, according to a twenty-second embodiment of the invention, of one or more levels 3 with press platens 2, a heating system with heat ducts 14 and with at least one steam system with steam distribution ducts 9 and steam directing passages 10 for the press platens 2, the steam directing passages 10 being equipped with steam orifices 11 aimed at the press surface, and, via separate passages, with a vacuum system 16, and with the exception of the brief steaming time, an air exhaust system can be connected to the steaming system, and for self-cleaning the steam orifices 11 are made with a reduction of the bore diameter from 6 mm to 3 mm.

A twenty-third embodiment, according to embodiment 22, is provided wherein if loading screens 19 are used the air exhausting system is connected to the steam orifices 11 at the screen 19 side.

A twenth-fourth embodiment, according to one or more of embodiments 22 and 23, is provided wherein the steam orifices 11 are in the form of slits 18.

A twenty-fifth embodiment, according to embodiments 22 to 24, is provided wherein the effective width d of the press platens 2 is not more than 200 mm greater than the average mat width b.

A twenty-sixth embodiment, according to embodiments 22 to 25, is provided wherein the size of the steaming surface of the press platens 2 is adjustable by stopping some steam directing ducts 10 by means of plugs.

A twenty-seventh embodiment, according to embodiments 22 to 26, is provided wherein the steaming area minus two marginal strips of 200 to 700 mm is adjustable.

A twenty-eighth embodiment, according to embodiments 22 to 27, is provided wherein the sealing of the mat 4 externally is provided by means of a sealing bar 22 applied to the margin of the press platen 2.

A twenty-ninth embodiment, according to embodiments 22 to 28, is provided wherein screens 19 of stainless steel fabric are arranged above and beneath the press platen 2.

A thirtieth embodiment, according to embodiments 22 to 29, is provided wherein the steam directing ducts 10 in the form of through-bores in the press platens 2 are made with the formation of two steam distribution ducts 9 by means of arranged marginal strips 20.

The priority document, DE 10337117.6, filed Aug. 11, 2003, including the specification, drawings, claims and abstract, is incorporated herein by reference in its entirety.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

We claim:

1. Method for the manufacture of wood material boards, wherein an endless mat of the material to be pressed is formed from a mixture of wood chips and binding agent, and is introduced between the heated press platens of a multi-platen press, the press platens having, in a second plane, steam directing channels fed at the margin from steam distributing channels having steam openings directed toward the mat, and therein, by means of steam and press platen contact heat, the mat is heated, pressed and cured into wood material boards, comprising the following steps:

(a) forming the mat from a wood chip and phenolic resin mixture and introducing the mat into the platen(s) of a single or multi-platen press;

(b) after a precompression, introducing a small amount of steam with a low steam temperature through the press platen(s) only into cover layers of the mat; and (c) then compressing the mat to the final thickness of the board and curing the mat.

2. Method according to claim 1, wherein the precompression of the mat is performed to a mat density of 100 to 500 $kg/m^3$ depending on the mat thickness.

3. Method according to claim 1, wherein the steaming of the mat takes place during a time period of 2 to 15 seconds.

4. Method according to claim 1, wherein the injection of the steam into the cover layers of the mat takes place with an amount of 60 to 185 $g/m^2$ according to the mat thickness.

5. Method according to claim 1, wherein the defined amount of steam is put into about 30% of the mass of the mat or the amount of steam per surface penetrates into 15% of the depth of the mat.

6. Method according to claim 1, wherein the steam is introduced with a temperature of 110° C. into the cover layers of the mat.

7. Method according to claim 1, wherein highly saturated steam and only slightly superheated steam is used, or steam superheated by only 20° C. is used.

8. Method according to claim 1, wherein only the cover layers are formed from a wood chip/phenolic resin mixture, while the wood chips of the middle layer of the mat are mixed with a binding agent.

9. Method according to claim 8, wherein the binding agent is a MDI adhesive.

10. Method according to claim 1, wherein the steam temperature is set as low as possible.

11. Method according to claim 1, wherein the introduction of the quantity of steam is regulated separately on the top surface and bottom surface of the mat.

12. Method according to claim 1, wherein after a light precompression, a defined amount of steam is introduced only into one of the surface layers of the mat through the press platens and then the mat is compressed to the finished dimension of the board.

13. Method according to claim 1, wherein treatment of the material with phenolic resin is performed with a mixture of adhesive powder and liquid glue.

14. Method according to claim 1, wherein in the wood chip and binding agent mixture, average chip lengths are not greater than 150 mm and average chip widths are not greater than 25 mm.

15. Method according to claim 1, wherein, for the production of especially smooth surfaces on the boards, thin chips with a thickness of 0.5 mm are used.

16. Method according to claim 1, wherein in the case of multi-stage presses a screen rotation is provided, wherein heating of the screen to about 100° C. is established in the press program at low specific pressure.

17. Method according to claim 16, wherein preheating of the screen at 100° C. is performed during the closing procedure of the platens.

18. Method according to claim 1, wherein a vacuuming of the mat and of the finished board is performed during the overall pressing process.

19. Method according to claim 18, wherein, at the end of the pressing process, a vacuum of 0.2 to 0.9 bar is applied to the steam directing ducts of the press platens.

20. Method according to claim 1, wherein separate ducts to upper and lower steam directing channels are provided in a press platen and a pulse of high pressure steam is performed through these ducts at the end of the pressing.

21. Method according to claim 1, wherein in the case of unilateral steaming of the mat from underneath, its upper side is sprayed with water before entry into the press.

22. Method according to claim 1, wherein aspiration from the mat is performed at about 0.02 bar during the pressing procedure.

23. Multi-platen press adapted to practice the method of claim 1 comprising:

one or more levels of press platens; and a heating system with heat ducts and with at least one steaming system with steam distribution ducts and steam directing ducts for the press platens, wherein the steam directing ducts are equipped with steam orifices at the press surface and a vacuum system and, with the exception of the brief steaming period, an air aspiration system can be connected to the steaming system, and wherein the steam orifices are made with a reduction of the bore diameter from 6 mm to 3 mm toward the mat as a self-cleaning configuration.

24. Multi-platen press according to claim 23, wherein if loading screens are used, the air exhausting system is connected to the steam orifices at the screen side.

25. Multi-platen press according to claim 23, wherein the steam orifices are in the form of slits.

26. Multi-platen press according to claim 23, wherein the effective width of the press platens is not more than 200 mm greater than the average mat width.

27. Multi-platen press according to claim 23, wherein the size of the steaming surface of the press platens is adjustable by stopping some steam directing ducts by means of plugs.

28. Multi-platen press according to claim 23, wherein the steaming area minus two marginal strips of 200 to 700 mm is adjustable.

29. Multi-platen press according to claim 23, wherein sealing of the mat externally is provided by a sealing bar applied to the margin of the press platen.

30. Multi-platen press according to claim 23, wherein screens of stainless steel fabric are arranged above and beneath the press platen.

31. Multi-platen press according to claim 23, wherein the steam directing ducts in the form of through-bores in the press platens are made with the formation of two steam distribution ducts by arranged marginal strips.

* * * * *